US010634468B2

(12) United States Patent
Naud et al.

(10) Patent No.: US 10,634,468 B2
(45) Date of Patent: Apr. 28, 2020

(54) MORTAR GAS FLOW INSERT

(71) Applicant: DMD Systems, LLC, Los Alamos, NM (US)

(72) Inventors: Darren Naud, Los Alamos, NM (US); Martin Forest Naud, Los Alamos, NM (US)

(73) Assignee: DMD Systems, LLC, Los Alamos, NM (US)

( * ) Notice: Subject to any disclaimer, the term of this patent is extended or adjusted under 35 U.S.C. 154(b) by 40 days.

(21) Appl. No.: 16/139,082

(22) Filed: Sep. 23, 2018

(65) Prior Publication Data

US 2020/0096299 A1 Mar. 26, 2020

(51) Int. Cl.
*F42B 4/20* (2006.01)
*F42B 4/02* (2006.01)
*F41F 1/06* (2006.01)

(52) U.S. Cl.
CPC ..... *F42B 4/20* (2013.01); *F41F 1/06* (2013.01); *F42B 4/02* (2013.01)

(58) Field of Classification Search
CPC ..... F42B 4/20; F42B 4/02; F41F 1/06; F41F 1/00; F41F 3/04
USPC ..... 102/357
See application file for complete search history.

(56) References Cited

U.S. PATENT DOCUMENTS 5,216,194 A * 6/1993 Boire ..... F41A 1/08 102/376
7,225,741 B2 * 6/2007 Huffman ..... F42B 5/045 102/433
9,726,466 B2 * 8/2017 Naud ..... F42B 12/42
2010/0139516 A1 * 6/2010 van Rooijen ..... F42B 4/22 102/335
2015/0233686 A1 * 8/2015 Naud ..... F42B 4/22 102/335

* cited by examiner

*Primary Examiner* — John Cooper
(74) *Attorney, Agent, or Firm* — James C. Kennedy, III Esq., LLC; James Kennedy

(57) ABSTRACT

A projectile launch container configured to propel one or more projectiles associated with pyrotechnic effects including a gas flow insert comprising a first face and a second face, the gas flow insert configured to be placed within the projectile launch container, the first face configured to underlie the projectiles and the second face configured to overlie a lift charge; the gas flow insert including a plurality of gas flow openings each fluidly connected to one or more gas flow channels that extend at least substantially axially to the launch container between the first and second faces, the plurality of gas flow openings on each of the first and second faces configured to control a flow of gases from an exploding lift charge entering the second face and exiting the first face; wherein the gas flow insert is configured to remain within the projectile launch container following detonation of the lift charge.

23 Claims, 5 Drawing Sheets

MORTAR GAS FLOW INSERT

FIELD OF THE INVENTION

This invention relates to a pyrotechnic/firework effect laminar-like gas flow promoting mortar insert that achieves improved and controlled delivery of pyrotechnic projectiles (effects) into the air from the mortar (e.g., launch tube) for subsequent secondary pyrotechnic/firework effects and whereby debris associated with propelling these effects from the mortar is reduced.

BACKGROUND OF THE INVENTION

Most fireworks or pyrotechnics displays launch projectiles or pyrotechnic effects from launch tubes including one-use disposable cardboard tubes. Pyrotechnic projectiles may be loaded with fireworks effects adjacent to or packed within a dispersive explosive.

Likewise, there may be one or more such as multiple projectiles (pyrotechnic effects) that may be propelled from a launch tube upon the ignition of a launch charge (lift charge). These projectiles or pyrotechnic effects may include many different types of effects such as stars that produce colored or spark effects, hummers, whistles, flash, and the like. The pyrotechnic device that propels from a mortar several stars or pyrotechnic effects may be called "mines" or "star mines."

Herein, the terms or phrase "multiple pyrotechnic projectiles or multiple pyrotechnic effects" may be collectively referred to as "effects."

In conventional operation of a mine, upon detonation of a lift charge within a launch tube (mortar), effects may be launched out of the tube as a result of explosive gas emanation from the launch tube as a result of the detonation. The manner of delivery into the air of effects may depend strongly on the behavior of detonation of the lift charge and the flow of gases produced thereby.

Subsequent to the lift charge explosion, the effects are ignited by the heat and fire of the explosive gas emanation out of the launch tube and the effects are further propelled along with the gases out of the launch tube and subsequently produce a typical visual pyrotechnic effect, such as one or more of colorful, sparkling, flash, sound, and/or streaming effects.

The effects come in many different shapes and sizes, but all are typically launched from a mortar launcher (such as a launch tube) by a lift charge, which may be contained in a lift charge container within the launch tube. For example, one suitable low-smoke producing launching system that may be used is found in U.S. Pat. No. 9,062,943, the disclosure of which is hereby incorporated by reference herein in its entirety.

Another suitable low-smoke producing launching system that may be used is found in U.S. Pat. No. 9,217,624 "Spooling pyrotechnic device" which is hereby fully incorporated herein by reference.

Several factors contribute to the effects being successfully raised to a desired selected altitude and with an aesthetic dispersion e.g., a symmetric pyrotechnic effect display. For example, the type and amount of lift charge used to propel the effects, the size and weight of the effects, the shape of the effects are some of the many factors that may be desirably controlled.

The dispersion of effects is described as the "pattern of display." Typically, an aesthetic pattern of display may be one where the projectiles or pyrotechnic effects have a symmetrical grouping.

A non-aesthetic pattern of display may be a pattern of display where the projectiles or pyrotechnic effects have a non-symmetrical grouping.

Examples of an aesthetic pattern of display may result when the effects are each propelled from the tube launcher with similar velocities.

Examples of a non-aesthetic pattern of display may be when the individual effects are propelled from the tube launcher or mortar with a wide range of velocities.

One problem associated with either a contained lift charge designed to burst a container upon ignition (see U.S. Pat. Nos. 9,062,943 and 9,217,624) or an uncontained lift charge such a black powder, is adequate control over the behavior of the effects discharged out of the launch tube upon ignition of the lift charge. In particular, it may be difficult to control the desired delivery of the effects due to non-uniformity (e.g., non-laminarity) of gas flow emanating as a result of ignition and explosion of the lift charge within the launch tube. A poor delivery of the effects caused by the relative turbulence or non-laminarity of the gas flow may produce a non-aesthetic (e.g., non-symmetric) pattern of display.

Another significant problem with prior art systems including the expulsion of effects into the air includes debris fallout associated with the lift charge detonation and/or debris associated with propelling the effects out of the mortar and/or the main burst including secondary detonation and burning.

Therefore there is a continuing need in the art to provide improved delivery of pyrotechnic effects from a launch tube with improved control over projectile launch behavior and with reduced debris fallout.

It is therefore among the objects of the invention to provide an improved device and method for delivery of pyrotechnic effects from a launch tube with improved control over projectile launch behavior and with reduced debris fallout.

These and other objects, aspects and features of the invention will be better understood from a detailed description of embodiments of the invention which are further described below in conjunction with the accompanying Figures.

SUMMARY OF THE INVENTION

A projectile launch container configured to propel one or more projectiles associated with pyrotechnic effects including a gas flow insert comprising a first face and a second face, the gas flow insert configured to be placed within the projectile launch container, the first face configured to underlie the projectiles and the second face configured to overlie a lift charge; the gas flow insert including a plurality of gas flow openings each fluidly connected to one or more gas flow channels that extend at least substantially axially to the launch container between the first and second faces, the plurality of gas flow openings on each of the first and second faces configured to control a flow of gases from an exploding lift charge entering the second face and exiting the first face; wherein the gas flow insert is configured to remain within the projectile launch container following detonation of the lift charge.

BRIEF DESCRIPTION OF THE DRAWINGS

The disclosure will now be made, by way of example, with reference to the accompanying drawings, in which.

DETAILED DESCRIPTION OF SOME PREFERRED EMBODIMENTS

By the term pyrotechnic effects is meant combustion driven effects such as explosions, flashes, smoke, flames, fireworks or other audio and/or visual effects. One or more, such as multiple pyrotechnic effects simultaneously being propelled out of a mortar are also referred to herein as "effects". By the term "explosive" is meant a substantially fast burning combustion driven by burning of energetic material. By the term energetic material is meant one or more of explosives, pyrotechnic compositions, fireworks, propellants and fuels. By the term "detonation" is meant a substantially fast burning combustion of energetic material that results in an explosion.

In some embodiments, a gas flow insert 100 is provided that may be included within a launch container (e.g., tube) that may achieve improved desired control of delivery and/or ignition of effects.

For example, it has been unexpectedly found that causing the gas flow subsequent to a lift charge explosion within and exiting the launch tube to be more laminar-like and/or less turbulent can desirably cause improved delivery of effects, in a more controlled manner (e.g., a more symmetric grouping) to result in a more aesthetic pattern of display.

For example, it has been unexpectedly found that a gas flow insert 100 according to embodiments herein may be configured to cause more laminar-like and/or less turbulent flow of combustion gases exiting a launch tube including from a bursting lift charge where a lift charge bursts a lift charge container upon detonation (e.g., 300 in FIGS. 1A-1C) to thereby improve the control over delivery of effects (e.g., 116 in FIGS. 1A-1C) propelled from the launcher (e.g. 200) and/or improve the ignition and burning of delay fuses associated with the effects.

In some embodiments, the pyrotechnic effects (e.g., 116) may include fuels such as nitrocellulose, including low-smoke formulations including nitro-guanidine and nitrocellulose as outlined in U.S. Pat. No. 6,599,379, "Low-smoke nitroguanidine and nitrocellulose based pyrotechnic compositions" which is hereby incorporated by reference in its entirety.

In other embodiments, the lift charge may be loose and/or contained in a lift charge container (see e.g., 300 in FIGS. 1A-1C) which may be configured to rupture along weakened areas in the container as set forth in U.S. Pat. Nos. 9,062,943 and 9,217,624, which are hereby incorporated by reference in their entirety.

For example, in some embodiments, a suitable low-smoke producing launching system that may be used is described in U.S. Pat. No. 9,217,624 "Spooling pyrotechnic device".

In some embodiments, the lift charge may include black powder only (see e.g., U.S. Pat. No. 9,062,943, Examples 1 and 2, and U.S. Pat. No. 9,217,624, Examples 1 and 2).

In other embodiments, the lift charge may include black powder and nitrocellulose as a co-lift (see e.g., U.S. Pat. No. 9,062,943, Example 3 and U.S. Pat. No. 9,217,624, Example 3).

Figures 1A, 1B, 1C:
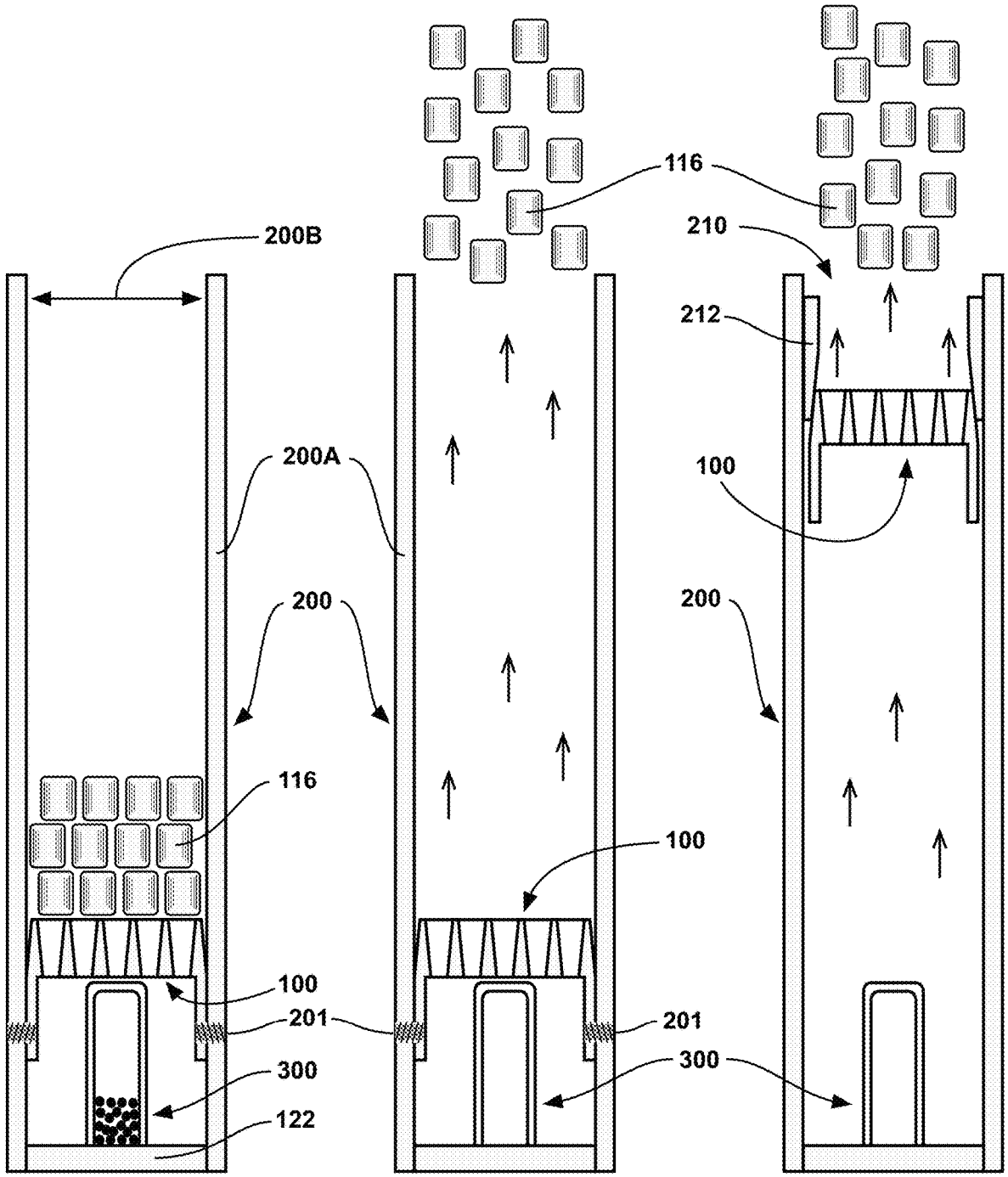
FIG. 1A is a schematic cross sectional illustration of an exemplary launch tube gas flow insert within a launch tube according to embodiments.
FIG. 1B is a schematic cross sectional illustration of an exemplary stationary launch tube gas flow insert within an exemplary launch tube according to embodiments.
FIG. 1C is a schematic cross sectional illustration of an exemplary moveable launch tube gas flow insert with an exemplary insert stop according to embodiments.

Referring to FIGS. 1A to 1C, gas flow insert 100 is shown positioned within a projectile (effects) launch container (e.g., tube) 200. It will be appreciated that the launch tube may be of any substantially uniform axially extending cross sectional geometry such as circular, or polygonal.

In some embodiments, e.g., FIG. 1C, the gas flow insert 100 may be configured to be moveable within the launch tube 200 upon a detonation of a lift charge e.g., 300 underlying the gas flow insert 100.

Referring to FIG. 1B in one embodiment, the gas flow insert 100 may be configured to be fixed in place during and following detonation of the lift charge within lift charge container 300.

For example, the gas flow insert 100 may be securely held in place by any conventional means such as by being fixed to the walls 200A of the launch container e.g., by screws or other mechanical fixtures 201 attached to the launch tube walls 200A to hold the gas flow insert 100 in place during the launch (lift charge detonation).

Additionally or alternatively, one or more annular stops may be provided extending inward from the inner diameter of the launch tube above and below gas flow insert 100 upper and lower circumferences to substantially prevent upward or downward movement of the gas flow insert 100 during and following detonation of the lift charge 300.

In another embodiment, the gas flow insert 100 may be alternatively or further fixed in place during and following detonation by being fixed to a top and/or side of the lift charge container 300 (which may be further fixed to a support plate e.g., 122) by e.g., glue and/or mechanical means such as a clamp and/or press fit, as are known in the art.

Figure 3A:
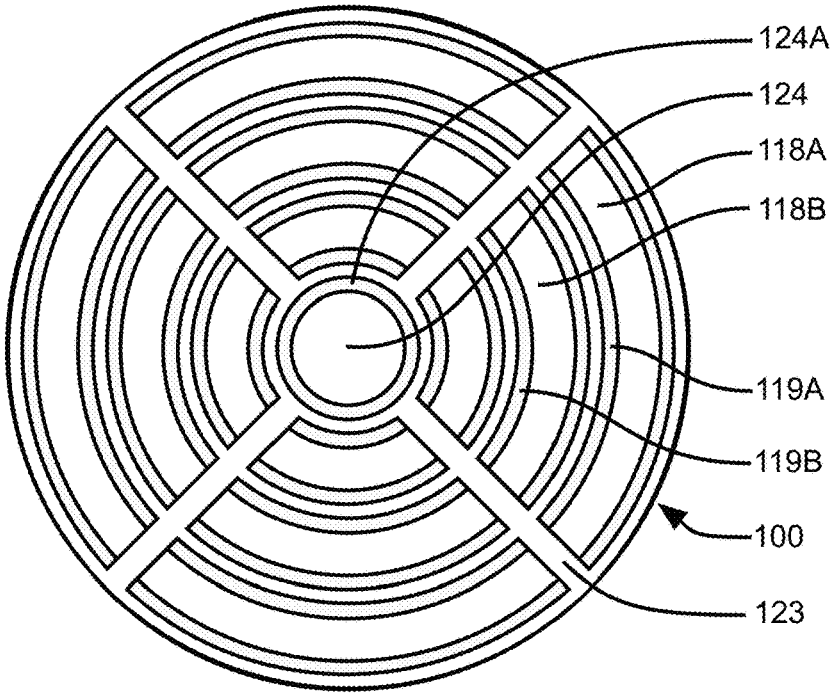
FIG. 3A is a schematic illustration of a top view of an exemplary launch tube gas flow gas insert face having a concentric pattern of gas flow channel openings according to embodiments.
Figure 3B:
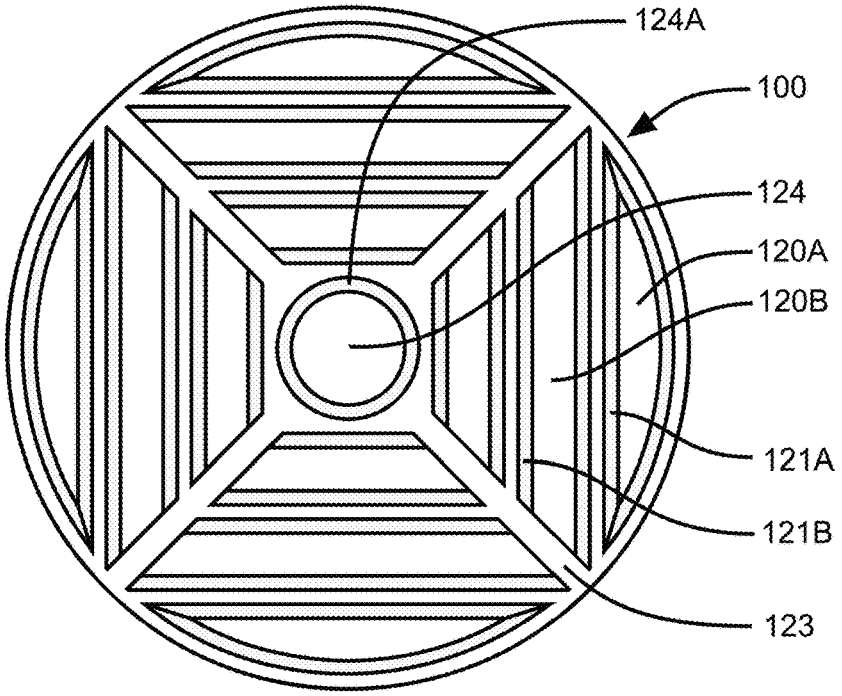
FIG. 3B is a schematic illustration of a top view of an exemplary launch tube gas flow insert gas exit face having a concentric pattern of gas flow channel openings according to embodiments.
Figure 3C:
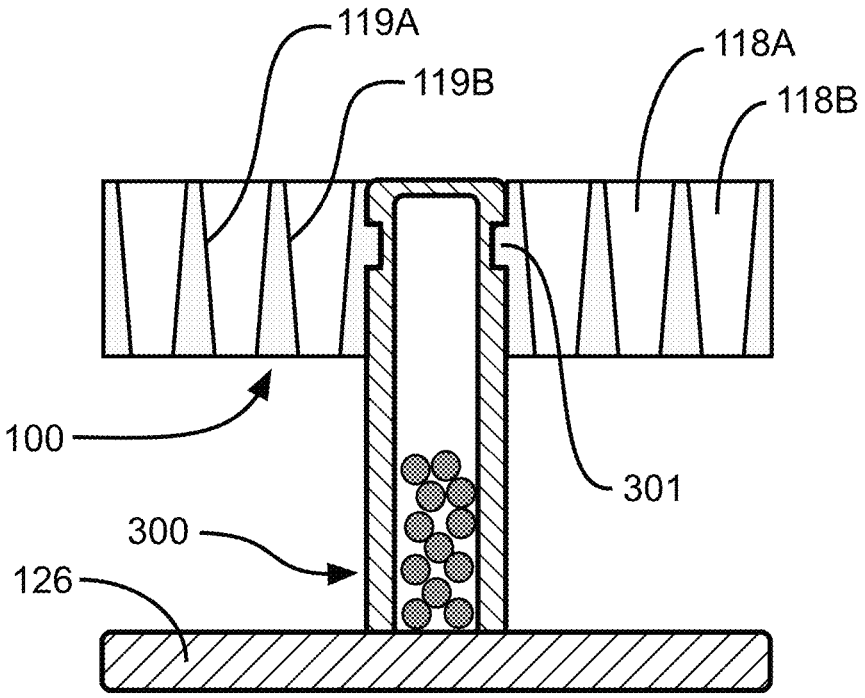
FIG. 3C is a schematic illustration of a cross sectional side view of an exemplary launch tube gas flow insert according to embodiments.

For example a slotted portion 301 in lift charge container 300 as shown in FIG. 3C fixed to a center portion of the gas flow insert 100 may be used as a mechanical fixing device to fix the gas flow insert 100 in place during and following detonation of the lift charge 300.

Referring to FIG. 1C, in one embodiment, the gas flow insert 100 may be configured to travel within the launch tube following detonation of the lift charge 300, for example to a point proximate the projectile exit end 210 of the launch tube where it may be stopped from further travel by stopping structures e.g., stopping structures 212 extending inward from the inner walls of the launch tube to intercept a circumference portion of the gas flow insert 100.

It will be appreciated that in other embodiments, the insert 100 may be stopped by stopping structures anywhere within the launch tube following detonation of the lift charge.

In one embodiment, the gas flow insert 100 may be stopped proximate the projectile exit end 210 of the launch tube by one or more stopping structures e.g., 212 that extend inward from the inner walls of the launch tube to intercept an outer circumference portion of the gas flow insert 100.

Figure 2A:
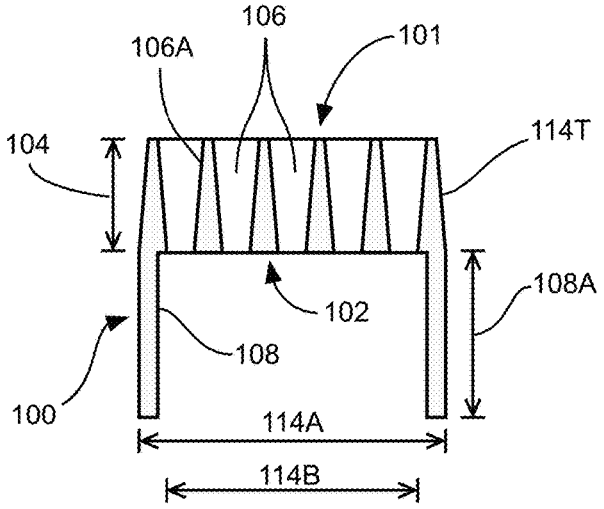
FIG. 2A is a schematic cross sectional illustration of a side view of an exemplary launch tube gas flow insert according to embodiments.
Figure 2B:
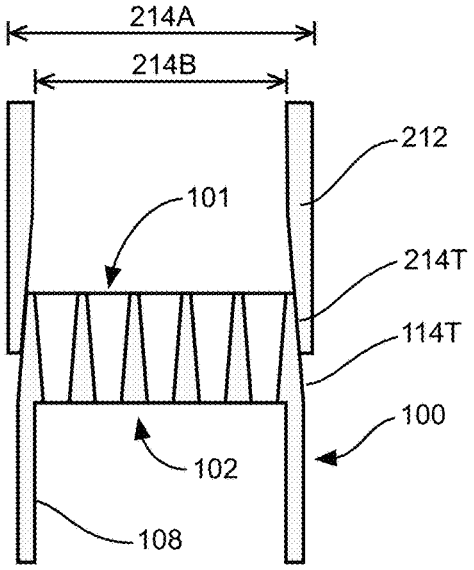
FIG. 2B is a schematic cross sectional illustration of a side view of an exemplary launch tube gas flow insert mated with an exemplary gas flow insert stop according to embodiments.

Referring to FIG. 2B, in one embodiment, the stopping structure 212 may be an annulus that has an outer diameter 214A that is substantially about the same an inner diameter of the launch tube and an inner diameter 214B that is configured to intercept and stop the gas flow insert 100, e.g., where the inner diameter of the stop annulus 212 may be equal and/or less than the outer diameter of the gas flow insert 100.

In another embodiment, the stop annulus 212 may have a tapered inner diameter portion 214T that may be tapered from a greater annulus thickness proximate the projectile exit end 210 to a lesser thickness at an opposite end of the stop annulus 212 configured to intercept the gas flow insert 100.

In some embodiments, the annulus may have a thickness of from about 5% to about 20% of the diameter of the gas flow insert 100.

In another embodiment, the gas flow insert 100 may have a tapered portion 114T that may taper from a first lesser diameter at the outer circumference adjacent the gas flow exit face 101 to a greater diameter at the outer circumference toward the gas flow entrance face 102 where it may be about equal to an outer diameter 114A of the gas flow insert 100 and where the outer diameter 114A may be substantially equal to an inner diameter 200B of the launch tube walls 200A.

In other embodiments, the stop annulus 212 may be untapered and may have a substantially uniform inner diameter 214B.

In some embodiments, the tapered portion 114T of the gas flow insert 100 may be configured to substantially mate with tapered portion 214T of the stop annulus 212.

In other embodiments, the gas flow insert 100 may be substantially untapered (substantially not tapered) at the gas flow exit face 101 and may have a substantially uniform outer diameter 114A.

Referring to FIG. 2A, in one embodiment, the gas flow exit face 101 of the gas flow insert 100 may extend substantially perpendicular to an axial direction of the gas flow insert 100 (and launch tube 200).

By the term "substantially" is meant a value varying from about 0% to about 5% of a correspondingly stated value and/or condition.

It will be appreciated that in other embodiments, the gas flow exit face 101 of the gas flow insert 100 may extend at an angle to the axial direction of the gas flow insert 100 (and launch tube 200).

In one embodiment the gas flow insert 100 includes a thickness (extending an axial length at the outer circumference) 104 between the gas flow exit face 101 and gas flow entrance face 102 through which a plurality of gas flow channels 106 extend substantially axially to the gas flow insert 100.

In some embodiments, the gas flow entrance face 102 may be substantially parallel to the gas flow exit face 101 and/or perpendicular to an axial direction of a launch tube when placed with the launch tube 200.

In other embodiments, the gas flow entrance face 102 and/or the gas flow exit face 101 may be slightly concave or convex in shape, e.g., having a tangential surface angle with respect to a flat horizontal face of from about 1 degree to about 15 degrees.

In some embodiments, the gas flow insert 100 may be configured to support one or more projectiles e.g., 116 on or above the gas flow exit face 101 within a launch tube 200.

In other embodiments, the gas flow exit face 101 within a launch tube 200 may be spaced away from the one or more projectiles e.g., 116.

In another embodiment, the gas flow insert 100 may include an axially extending lip portion 108 at the circumference of the insert 100, adjacent the launch tube walls, such as an annulus having a portion 108 that extends axially away from the gas entrance face 102 with a length 108A.

Referring to FIG. 2A, in some embodiments, the gas flow insert 100 lip portion 108 may have a length 108A sufficient to impart stability during movement following lift charge detonation.

For example, in some embodiments, the length 108A may be from about ¼ to about 1 times the length of the inner diameter 200B of the launch tube.

In some embodiments, the axially extending lip portion 108 may include openings and/or slots extending through the lip portion 108 along the thickness portion 108.

In some embodiments, one or more of the gas flow openings 106 may be fluidly connected to and/or defined by one or more gas flow channels having defined by associated channel walls 106A where one or more of the channel walls 106A is tapered continuously at an angle between the gas flow faces, 101, 102.

In one embodiment, one or more of the gas flow channels defined by channel walls 106A and fluidly associated with one or more gas flow openings 106 may be tapered continuously at an angle between the gas flow faces, 101, 102 such that an associated channel width dimension and/or opening width dimension of one or more of the channel openings 106 on the gas exit face 101 is larger than one or more of a fluidly associated channel dimension and/or opening dimension 106 on the gas entrance face 102.

In other embodiments, one or more of the gas flow channels defined by channel walls 106A and fluidly associated with one or more gas flow openings 106 may be tapered continuously at an angle between the gas flow faces, 101, 102 such that an associated channel width dimension and/or opening width dimension of one or more of the channel openings 106 on the gas exit face 101 is smaller than one or more of a fluidly associated channel dimension and/or opening dimension 106 on the gas entrance face 102.

In some embodiments, the taper angle may be from about 0.5 degrees to about 30 degrees from vertical or with respect to an axial direction of the gas flow insert 100.

In some embodiments, one or more of the channel walls 106A associated with a respective channel opening at a respective face 102 and/or 101 may have a width (e.g., distance between respective channel openings 106) of from about ⅕ of a channel opening 106 dimension (e.g. diameter or width at a respective face) to about 2× (twice) of a channel opening dimension (e.g. diameter or width at a respective face).

In other embodiments, the gas flow channels and/or channel openings 106 may be fluidly associated with one or more untapered channel walls 106A e.g., defining a channel shape substantially uniform in dimension along a length of the channels e.g., along an axial direction to the gas flow insert 100 (e.g., co-axial to the launch tube).

In some embodiments, the one or more gas flow channels defined by associated channel walls 106A and associated with one or more gas flow channel openings 106 may extend substantially axially to the launch tube 200 when the gas flow insert 100 is placed within the launch tube 100.

In some embodiments, the gas flow channel openings 106 on at least one face 101, 102 may be configured in at least one of a substantially uniform and irregular array (pattern) of openings, including the openings 106 having at least one selected geometry which may be fluidly associated with the same or another geometry of one or more fluidly associated channels defined by channel walls 106A extending substantially axially between the gas entrance 102 and gas exit faces 101.

In one embodiment, the selected geometry may be one or more of circular, ellipsoidal, and polygonal (e.g., rectangular), including a honeycomb shaped (e.g., five or six sided channel wall 106A configurations of the channel and/or one or more fluidly associated channel openings 106.

Figure 2C:
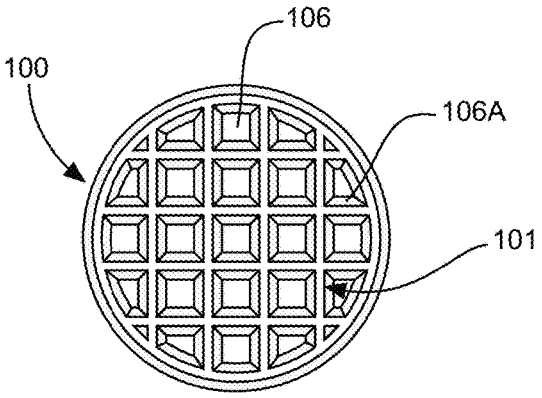
FIG. 2C is a schematic illustration of a top view of an exemplary launch tube gas flow insert gas exit face having an exemplary patterned array of gas channel exit openings according to embodiments.

Referring to FIG. 2C is shown an exemplary embodiment having a substantially uniform rectangular array of channel openings 106 each defined by respective channel walls 106A.

In some preferred embodiments, a plurality of gas flow channels may be provided in a patterned array of channel openings positioned over an area extending from a central portion radially across substantially the entire diameter of the gas insert 100. For example, such a configuration may result in a more laminar-like flow (increased laminarity of flow) of gases exiting from the gas flow insert 100, and consequently the launch tube 200.

For example, it may be preferred that the gas flow exiting from the gas flow insert face 101 is made more laminar-like and/or less turbulent by selected configurations of the patterned array of channel openings (e.g., within an area extending radially substantially from a central portion to proximate an outer circumference of a gas flow insert 100) to improve a distribution of pyrotechnic effects projectiles out of the launch tube 200.

It will be appreciated that in other embodiments, the configuration of the channel openings and associated gas flow channels may be configured to produce less laminar-like flow and/or include a controlled turbulent gas flow, for example, by configuring a gas exit (and entrance) face (e.g., 101, 102) having associated channel openings (e.g., 106) in a patterned array positioned primarily centrally and/or primarily circumferentially (proximate a circumference of a respective face e.g., 101, 102) to achieve a desired distribution of pyrotechnic effects projectiles (e.g., 116).

Referring to FIGS. 3A and 3B, in another embodiment the gas flow inert 100 may have openings in the shape of one or more concentrically positioned slotted channel openings e.g., 118A, 118B, 120A, 120B which may have channel walls e.g., 119A, 119B, 121A, 121B which define adjacent channel openings.

It will be appreciated that the concentric slotted channel openings e.g., 118A, 118B, 120A, 120B may be concentrically positioned in at least one of a circular and polygonal pattern at one or more faces 101, 102 (e.g. rectangular as shown in FIG. 3B).

In some embodiments, a concentric slotted channel opening at a given radius on a gas insert face may have a maximum dimension that extends around the entire gas insert face as shown in FIGS. 3A and 3B.

In other embodiments, there may be one or more concentric slotted channel openings at a given radius on a gas insert face that have a maximum dimension that may extend partially (e.g., partially concentric) around a radius of a gas insert face.

It will be appreciated that in some embodiments the gas flow inert 100 may have gas flow openings on one or more respective faces 101, 102 in the shape of one or more concentrically positioned slotted channel openings (e.g. FIGS. 3A and 3B) and/or in a patterned array of openings (e.g., FIG. 2C) and each gas flow opening may be associated with one or more gas flow channels defined by respective gas flow channel walls.

In some embodiments, structural support portions e.g., 123 may extend between the concentric slotted opening channel walls e.g., 119A, 119B, 121A, 121B and/or between a central portion of a gas insert 100 face 101 and/or 102 to proximate a circumferential portion of a respective face to provide structural support.

In some embodiments, as shown in FIG. 3C, the concentric slotted channel openings e.g., 118A, 118B, 120A, 120B may be associated with one or more channel walls e.g., 119A, 119B, 121A, 121B one or more of which may be tapered at an angle (e.g., from about 0.5 degrees to about 30 degrees with respect to vertical to a face 101, 102).

In some embodiments an opening size dimension (e.g., minimal width dimension) of one or more of the slotted channel openings on a gas exit face 101 is larger than a corresponding opening size dimension on a gas entrance face 102.

In some embodiments, the gas flow insert 100 may have each respective face 101,102 having at least one of a patterned array of openings (e.g., FIG. 2A) and concentric slotted openings (e.g., FIG. 3A, 3B).

In one embodiment, the gas flow insert 100 including one or more concentric slotted channel openings e.g., 118A, 118B, 120A, 120B may be fixed in place within the launch tube 200 during and following a detonation of a lift charge.

In other embodiments, the gas flow insert 100 including one or more concentric slotted channel openings e.g., 118A, 118B, 120A, 120B may be mobile within the launch tube and be stopped by a mechanical exit stop e.g. 212 (FIG. 2B), prior to exiting the launch tube.

In one embodiment, the gas flow insert 100 having at least one of a patterned array of openings and concentric slotted openings on a respective face, e.g., 101, 102 may have a center space e.g., 124 in FIG. 3C configured to receive a lift charge container e.g. 300.

Referring to FIG. 3C, in some embodiments the lift charge container 300 may be fixedly attached to the gas flow insert 100 having at least one of an array of openings and concentric slotted openings e.g., at an outer circumference 124A of center space 124 by mechanical fixtures and/or structures e.g., slotted portion 301 in lift charge container 300 and/or glue sufficient to withstand the lift charge detonation.

In other embodiments, the lift charge container 300 may be tightly fitted but not fixedly attached to the gas flow insert 100 (e.g., at the outer circumference 124A) and which may be moveable within the launch tube following lift charge detonation.

It will be appreciated that it may be desirable in some embodiments to make the fitting between the gas flow insert and the lift charge container substantially gas tight to prevent gas leakage outside the gas flow channels during and following detonation.

Referring to FIG. 3C, in some embodiments, the lift charge container 300 and the flow insert 100 may be supported on a support plate e.g., 126 that may be configured (e.g., attached) to be fitted within a launch tube.

In some embodiments, molding methods, such as conventional wet or dry molding methods, including one or more methods including pressing, molding, and injection molding may be used to form the gas flow insert 100.

In other embodiments, 3-D printing methods may be desirable to form the gas flow insert 100 where conventional plastics may be used to form one or more curable or cured printed layers such as additive layers which may be treated to catalyze/cure the layers between printing of layers and/or following printing of a completed shape.

In other embodiments, the gas flow insert 100 may be shape formed in separate pieces by one or more methods including pressing, molding, injection molding, and 3-D additive layer printing and then attaching the separate pieces e.g., along seams to form a completed part, for example, with a non-combustible glue and/or a glue able to structurally withstand a lift charge detonation.

In other embodiments, the gas flow insert 100 may include cross-linkable organic polymers, such as in a binder and/or additive, the cross linking taking place during or following shape forming, for example, using a cross linking treatment including one or more of heating, radiation, and/or addition of cross linking catalysts and/or accelerants to cross link the organic polymers.

In other embodiments, the binder may include one or more polymerizable or cross-linkable materials such as thermosetting polymers, rubber, including one or more of polybutadiene, polyurethane, furans, and organic resins such as acrylic resins, polyester resins, epoxy resins, vinyl and vinyl ester resins.

Figure 4:
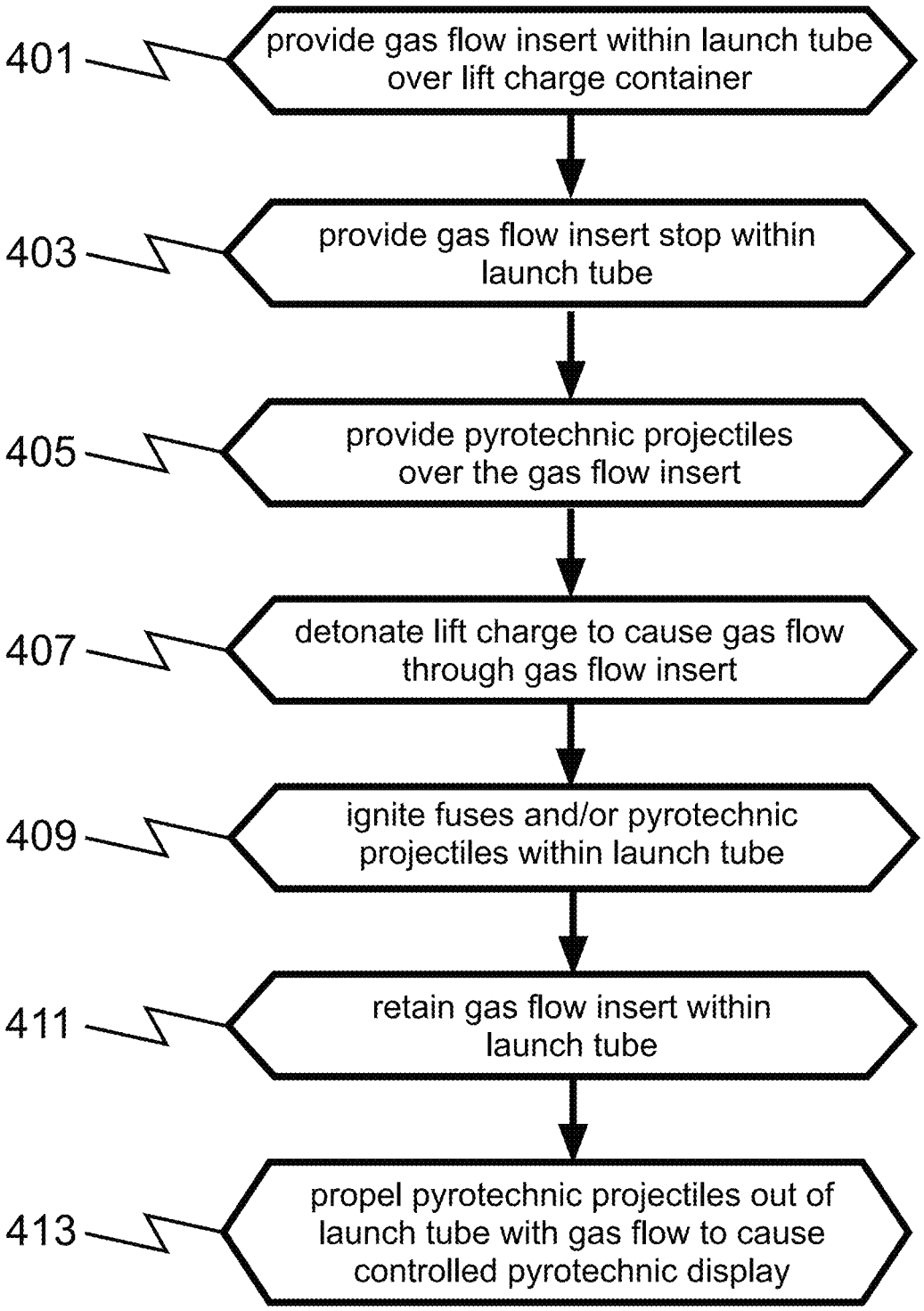
FIG. 4 is an illustration of an exemplary method of carrying out a pyrotechnic effects launch and display using the projectile launch tube gas flow insert according to embodiments.

Referring to FIG. 4, in a method of operation, in step 401, a launch tube gas flow insert is provided within a mortar (e.g., launch tube) overlying a lift charge.

In step 403, secure the gas flow insert and/or provide a gas flow insert exit stop within the launch tube.

In step 405, one or more pyrotechnic effect projectiles may be placed supported on the launch tube gas flow inert.

In step 407 the lift charge is ignited to produce an explosive force including heated gases which emanate upward through gas flow channels in the gas flow insert in a selected controlled flow pattern to propel the projectiles upward within the launch tube.

In step 409, the one or more of the pyrotechnic effect projectiles may have a delay fuse and/or an external portion of the pyrotechnic effect projectile ignited by the gas flow within the launch tube.

In step 411 the gas flow insert is configured to be retained within the launch tube during and/or following lift charge detonation.

In step 413, the projectiles are propelled out of the launch tube into the air by the controlled flow pattern to produce a controlled formation of propelled effects which may result in one or more pyrotechnic aerial displays.

Although the embodiments of this disclosure have been described with respect to certain exemplary embodiments, it is to be understood that the specific embodiments are for purposes of illustration and not limitation, as other variations will occur, to those of skill in the art.

What is claim is:

1. A projectile launch container configured to propel one or more projectiles associated with pyrotechnic effects comprising:

a gas flow insert comprising a first face and a second face connected by a wall, the second face comprising an open bottom end of the gas flow insert, the gas flow insert configured to be placed within the projectile launch container supported adjacent the projectile launch container, the open bottom end in fluid communication with the projectile launch container, the first face configured to underlie the projectiles and the second face configured to one of overlie a lift charge and be attached to the lift charge;

the gas flow insert comprising a plurality of gas flow openings each fluidly connected to one or more gas flow channels that extend at least substantially axially to the launch container between the first and second faces, the plurality of gas flow openings on each of the first and second faces configured to selectively control a flow of gases including turbulence from an exploding lift charge entering the second face and exiting the first face;

wherein the gas flow insert is configured to remain within the projectile launch container following detonation of the lift charge.

2. The projectile launch container claim 1, wherein the plurality of gas flow openings comprise a patterned array of gas flow openings having at least one of a width and diameter dimension less than a length of a fluidly associated gas flow channel.

3. The projectile launch container of claim 2, wherein the plurality of gas flow openings comprise openings on the first and second faces that are substantially the same dimensions.

4. The projectile launch container of claim 2, wherein the plurality of gas flow openings comprise openings on the first and second faces that are substantially different dimensions.

5. The projectile launch container of claim 1, wherein the plurality of gas flow openings each define an associated gas flow channel.

6. The projectile launch container of claim 1, wherein the one or more gas flow channels are each defined by associated channel walls, at least one of the channel walls continuously tapered along an axial direction between the first and second faces.

7. The projectile launch container of claim 1, wherein the plurality of gas flow openings each comprise a geometry selected from the group consisting of circular, polygonal, and ellipsoidal.

8. The projectile launch container of claim 1, wherein the one or more gas flow channels comprises a geometry selected from the group consisting of circular, polygonal, and ellipsoidal.

9. The projectile launch container of claim 1, wherein the plurality of gas flow openings comprise concentrically positioned gas flow openings.

10. The projectile launch container of claim 9, wherein each of the concentrically positioned openings comprise a maximum width greater than a length of a fluidly associated gas flow channel extending between the first and second faces.

11. The projectile launch container of claim 9, wherein the concentrically positioned openings each comprise a maximum width dimension extending at least partially around a radius of at least one of the first and second faces.

12. The projectile launch container of claim 11, wherein the concentrically positioned openings comprise at least one of a concentric circular and concentric polygonal pattern on at least one of the first and second faces.

13. The projectile launch container of claim 9, wherein the concentrically positioned openings comprise openings on the first face that comprise a minimal width that is different than a minimal width of fluidly associated concentrically positioned openings on the second face.

14. The projectile launch container of claim 9, wherein the concentrically positioned gas flow openings are fluidly associated with at least one channel wall that is continuously tapered along an axial direction between the first and second faces.

15. The projectile launch container of claim 1, further comprising a mechanical stop configured to stop the gas flow insert from exiting the projectile launch container following detonation of the lift charge and associated movement of the gas flow insert within the projectile launch container.

16. The projectile launch container of claim 1, further comprising a mechanical stop configured to maintain the gas flow insert in place overlying the lift charge following detonation of the lift charge.

17. The projectile launch container of claim 1, wherein the lift charge comprises at least one of an explosive material contained in a container configured to burst upon detonation and an uncontained explosive material.

18. The projectile launch container of claim 1, wherein at least one of the pyrotechnic effects and the lift charge comprise nitrocellulose.

19. A method for controlling a delivery of one or more projectiles comprising pyrotechnic effects propelled from a projectile launch container comprising:

providing a gas flow insert comprising a first face and a second face connected by a wall, the second face comprising an open bottom end of the gas flow insert;

placing the gas flow insert within the projectile launch container supported adjacent the projectile launch container, the open bottom end in fluid communication with the projectile launch container, the first face positioned to underlie one or more projectiles and the second face positioned to one of overlie a lift charge and be attached to the lift charge;

placing the projectiles over the first face;

the gas flow insert is formed to comprise a plurality of gas flow openings associated with one or more gas flow channels extending at least substantially axially to the launch container between the first and second faces;

detonating the lift charge to cause lift charge explosion gases to enter gas flow openings through the second face and exit the first face to cause a controlled gas flow including a selectively controlled turbulence of the gas flow to propel the projectiles out of the projectile launch container; and, causing the gas flow insert to remain within the projectile launch container following detonation of the lift charge.

20. The method of claim 19, wherein the plurality of gas flow openings comprise gas flow openings having at least one of a width and diameter dimension less than a length of a fluidly associated gas flow channel.

21. The method of claim 19, The projectile launch container claim 1, wherein the plurality of gas flow openings comprise gas flow openings having at least one of a width and diameter dimension greater than a length of a fluidly associated gas flow channel.

22. The method of claim 19, wherein the projectile launch container claim 1, wherein the projectiles are delivered in a pre-determined grouping pattern upon exiting the launch tube.

23. A projectile launch container configured to propel one or more projectiles associated with pyrotechnic effects comprising:

a gas flow insert comprising a first face and a second face, the second face comprising an open bottom end of the gas flow insert, the gas flow insert configured to be placed within and supported adjacent the projectile launch container, the open bottom end in fluid communication with the projectile launch container, the first face configured to underlie the projectiles and the second face configured to one of overlie a lift charge and be attached to the lift charge;

the gas flow insert comprising a plurality of gas flow openings each fluidly connected to one or more gas flow channels that extend at least substantially axially to the launch container between the first and second faces, the plurality of gas flow openings on each of the first and second faces configured to selectively control a flow of gases including a turbulence of said gas flow from the lift charge entering the second face and exiting the first face;

wherein the gas flow insert is configured to remain within the projectile launch container following detonation of the lift charge including at least one of:

a container containing the lift charge attached to the gas flow insert, a mechanical stop on the projectile launch container configured to stop the gas flow insert from exiting the projectile launch container following detonation of the lift charge, and the gas flow insert fixedly attached to the projectile launch container.

* * * * *